United States Patent [19]

Muller et al.

[11] 4,343,884

[45] Aug. 10, 1982

[54] DIAZOTYPE DEVELOPING PROCESS AND ACIDIC DEVELOPER WITH AMINE BASE SALT

[75] Inventors: Peter Muller; Henry Mustacchi, both of Port Washington, N.Y.

[73] Assignee: Andrews Paper & Chemical Co., Inc., Port Washington, N.Y.

[21] Appl. No.: 220,423

[22] Filed: Dec. 29, 1980

[51] Int. Cl.[3] ..... G03C 5/34

[52] U.S. Cl. ..... 430/149; 430/148; 430/154; 430/157; 430/162; 430/171; 430/183; 430/331

[58] Field of Search ..... 430/149, 151, 154, 331, 430/309, 179

[56] References Cited

U.S. PATENT DOCUMENTS

| | | | |
|---|---|---|---|
| 2,308,058 | 1/1943 | Crowley et al. | 430/149 |
| 3,578,452 | 5/1971 | Parker | 430/149 |
| 3,809,560 | 5/1974 | Neuman | 430/149 |
| 4,128,423 | 12/1978 | Vosbeck | 430/149 |
| 4,155,762 | 5/1979 | Matsuda et al. | 430/149 |
| 4,286,041 | 8/1981 | Von de Vorle | 430/149 |

FOREIGN PATENT DOCUMENTS

| | | | |
|---|---|---|---|
| 48-71230 | 9/1973 | Japan | 430/149 |
| 919812 | 2/1963 | United Kingdom | 430/149 |

*Primary Examiner*—Charles L. Bowers, Jr.
*Attorney, Agent, or Firm*—Kane, Dalsimer, Kane, Sullivan and Kurucz

[57] ABSTRACT

One component diazotype material is imagewise exposed and developed odorless and curlfree with 0.6–4.5 $g/m^2$ per square meter of a substantially water free liquid developer in a pressure development or transfer roller apparatus.

13 Claims, No Drawings

DIAZOTYPE DEVELOPING PROCESS AND ACIDIC DEVELOPER WITH AMINE BASE SALT

BACKGROUND OF THE INVENTION

1. Field of the Invention

The invention relates to diazotypy and more particularly relates to methods and compositions for developing diazotype materials.

2. Brief Description of the Prior Art

Diazotype materials and processes have been widely described in the literature; see for example the text "Light Sensitive Systems", J. Kosar, John Wiley and Sons Inc., N.Y., N.Y. (1965).

In general, diazotype prints are obtained by an imagewise exposure of a light-sensitive diazo material to ultraviolet light followed by development of the exposed diazotype material. There are several different methods available to develop the latent image imposed on the light-sensitive diazo material by the light exposure. The following image development methods have found commercial application:

(1) ammonia development;
(2) amine development;
(3) thermal development; and
(4) moist (liquid) development All of the methods have had advantages as well as certain shortcomings or inconveniences. For example, the ammonia development process requires the handling of liquid or anhydrous ammonia. Even if the developing machine fully contains the ammonia vapors, some residual ammonia adheres to finished prints and releases therefrom, inconveniencing the environment. Amine development, as described for example in U.S. Pat. Nos. 3,446,620; 3,349,908; 3,578,452 and 3,809,559 overcomes many of the problems associated with ammonia development, but fresh prints released from the processing apparatus have a tacky surface imparted by the alkaline amine, with a resulting unpleasant feel to the skin. In addition, "ghost" printing occurs. This consists of a repeat image transferred to the activator transfer roller from the print dye. Also, print backgrounds tend to discolor after short storage periods. This is very pronounced in blackline diazotypes developed with amines. Another inconvenience is due to volatility of even high boiling amines. Following prolonged use of the development equipment the amine evaporates into the atmosphere and then deposits on cold surfaces in the room. The volatilized amines also usually possess an undesirable odor.

Diazotype prints developed by thermal development methods suffer from serious shelf life problems unless the paper is not only kept very dry but also at low storage temperatures. Thermally developed diazotype prints also release volatiles into the surrounding atmosphere, at the elevated development temperatures encountered.

Moist or liquid development is probably the oldest commercial diazotype developing process and is used to develop the so called "one component" diazotypes. Such reprographic diazo material contains besides stabilizers and other additives, the light sensitive diazo compound. No coupler is present with the diazo compound. After imagewise exposure, the diazotype surface is contacted with an aqueous developer containing one or more couplers and buffer salts to neutralize the stabilizers in the diazotype layer. The coupler reacts with the diazo compound to generate print dye development.

The method is not without disadvantages. As the water in the developer solution penetrates the print surface, it tends to swell the cellulosic fiber of the diazotype base paper. Later on drying, shrinkage occurs and results in a curling of the print. To overcome the curl problem, liquid development machines have been made which apply developer to both sides of the sheet and thus balance fiber swell and shrinkage. Also, diazo prints processed by moist development pick up a total of approximately 20 gms of water per square meter, which subsequently has to be dried out by processing the print through a dryer station at elevated temperatures. This may be a severe energy requirement for a commercial diazotype development operation. In any event, having to apply large excesses of aqueous developer solutions to both sides of the support paper and dry it is an expensive, wasteful procedure.

The moist development process has been advocated for general office use because of the relative absence of odors generated. The need for evaporating circa 20 $g/m^2$ of water at elevated temperatures however, is counterproductive to airconditioning in an air conditioned office. Moreover, the developer solutions tend to oxidize and become dark and have to be replaced frequently, combined with a thorough cleaning of the developer machine.

Recently a moist development process has been proposed (see U.S. Pat. No. 4,128,423) which remedies various shortcomings of the classical moist development process. By the new process one applies between 1.5 to 4.5 $cm^3$ of developer per square meter, only to one side of the light-sensitived paper. This corresponds to from 2 to 6% of the average print weight. No print dryer is required. The developer is spread onto the print surface with the aid of a transfer roller, adapted to transfer 1.5 to 4.5 $cm^3$ of developer per square meter of print surface. Conventionally coated one component diazotype papers would produce a pronounced curl when treated in this manner, as the water from the developer wets only one side of the print (see the discussion of this phenomenon given above). In order to overcome this phenomenon the U.S. Pat. No. 4,128,423 teaches the application of a special plastic sealer undercoat to the paper support. The sealer provides impermeability to water. The light sensitive diazo coating consists of a self contained layer with pigments and resin binders since it cannot anchor within the surface layer of the support. Upon development, the water of the developer solutions cannot penetrate into the paper fibers of the base and the print does not curl. It is also proposed to apply the sealer undercoat to both sides of the base to prevent curl from developer solution which may touch the backside of the print. Those skilled in the art appreciate that the application of a sealer undercoat is a delicate procedure and requires substantial coating weights to be effective. Since the sealer layer is hydrophobic and the light sensitive overcoating is hydrophylic, this latter layer must be carefully formulated and requires a substantial thickness and coating weight. Such coatings are difficult to apply successfully and conventional diazotype coating machines are not adapted to handle them. The special coating process increases the manufacturing costs of the diazo material far above those of conventionally coated, one component diazotypes.

It is an objective of the present invention to overcome the shortcomings described above, particularly as they relate to the moist development process and to provide a superior diazotype print product and a highly economic process. It is a further objective of the invention to provide a moist development process that can be practiced in any commercial processing equipment that permits the transfer and spread of from 0.6 to 4 g/m$^2$ of developer liquid to a diazotype print surface.

The method of the invention is odorless. The developer components are non-volatile under the development process conditions and do not enter into the work atmosphere surrounding the printing apparatus. The developer solution of the invention employs a vehicle which does not swell the cellulosic fibers of the base paper, obviating the problem of curling of the developed print and a need for drying the developed print. Further, in the developer solutions of the invention, the ingredient buffer salts of amines or amino alcohols and low molecular weight organic acids are liquid oils or waxes which do not tend to crystallize or solidify as do alkali salts in prior art developer solutions.

The process of the present invention is also advantageous in that contrary to the amine development process, no "ghost" repeat images occur on transfer prints. Other advantages of the process of the invention will be described below.

SUMMARY OF THE INVENTION

The invention comprises a liquid developer for the moist development of a latent image on a light-sensitized and exposed diazotype material, which comprises;

(a) an azodye coupler;

(b) a non-volatile salt of an amine base and a carboxylic acid having a molecular weight of from 46 to about 210; and (c) a liquid, non-volatile, organic diluent for (a) and (b) described above, selected from the group consisting of polyhydric alcohols and their partial ethers;

said developer having a pH within the range of from about 5.5 to about 7.0. The term "non-volatile" as used throughout the specification and the claims means that the salt or compound does not vaporize to any significant degree at room temperatures and under atmospheric pressures.

The invention also comprises the moist development of diazotype materials with the liquid developer of the invention, which development is advantageous for its providing odor-free, non-curling, positive diazo prints.

DETAILED DESCRIPTION OF THE INVENTION

The liquid developer solutions of the invention may be prepared by simple admixture of an azodye coupler with the non-volatile salt of the amine and a carboxylic acid and the organic diluent. Azodye couplers are generally well known in the art as is their preparation. Azodye couplers are generally aromatic compounds with phenolic hydroxyl groups and with or without other substituent groups. The couplers are generally colorless. Representative of azodye couplers are:

1. Resorcinol and its halogen and alkyl derivatives and mono ethers;
2. Resorcylic acids with or without halogen substitution in the ring and their amides and substituted amines;
3. Dihydroxy naphthalene mono sulfonic acids and disulfonic acids;
4. Dihydroxy naphthalenes;
5. Beta and alpha-hydroxy naphthoic acid amides and substituted amides;
6. Compounds with active methylene groups such as aceto-acet derivatives and cyano acet derivatives;
7. Mono and poly hydroxy biphenyls;
8. Poly hydroxy biphenyl sulfides;
9. Pyrazolone derivatives;
10. Amino phenol derivatives; and the like.

Preferred as azodye coupler components of the developer solutions of the invention are those couplers which have higher coupling strengths than those conventionally employed in 2-component diazotype materials. Representative of the higher coupling strength couplers are resorcinol, pyrazolone derivatives, phloroglucinol, mixtures thereof and the like. The proportion of azodye coupler admixed in the developer solutions of the invention may vary over a wide range. Sufficient azodye coupler is present to couple the diazonium component in the diazo material. In general, the diazo material may contain up to 40 gms/liter (1.195 milliequivalents) of diazonium component. With a coating of say 15 cc/m$^2$ to the base support there is a deposit of up to 1.425 milliequivalents of the diazonium per square meter, needing up to 1.78 milliequivalents of azodye coupler per cc of developer solution, calculated on an application rate of 0.8 cc/m$^2$. Preferably the azodye coupler is present in the developer in a proportion so that when the developing solution is spread on the diazotype material for development at a rate of 0.8 to 5.0 grams developer/square meter of surface of diazotype material, there will be deposited 0.2 to 4.0 milli-equivalents of the azodye coupler per square meter, i.e., about 0.25 to 5.00 milli-equivalent of azodye coupler per gram of developer solution.

The non-volatile salt of an amine base and a carboxylic acid is a buffer salt, which may be prepared by the reaction of substantially equivalent proportions of the amine and the carboxylic acid reactants. Representative of the amine reactants which may be used to prepare the buffer salts are amines having the general formula:

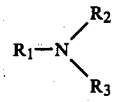

(I)

wherein $R_1$, $R_2$ and $R_3$ independently are members selected from the group consisting of alkyl, cycloalkyl, hydroxyalkyl, alkoxy and hydrogen; and $R_2$ and $R_3$, taken together, are a divalent moiety of the formula:

$$-CH_2-CH_2-Y-CH_2-CH_2- \quad \text{(II)}$$

wherein Y is a member selected from the group consisting of O, $CHR_1$ and $NR_1$, wherein $R_1$ is as defined above. The amine base selected must be capable of salt formation.

The term "alkyl" as used herein means the monovalent moiety obtained upon removal of a hydrogen atom from a parent aliphatic hydrocarbon. Representative of alkyl are alkyl of 1 to 25 carbon atoms, inclusive, such as methyl, ethyl, propyl, butyl, pentyl, hexyl, heptyl, octyl, nonyl, undecyl, decyl, dodecyl, octadecyl, nonodecyl, eicosyl, heneicosyl, docosyl, tricosyl, tetracosyl, pentacosyl and the isomeric forms thereof.

The term "cycloalkyl" as used herein means the monovalent moiety obtained upon removal of a hydrogen atom from a parent cyclic aliphatic hydrocarbon. Representative of cycloalkyl are cycloalkyl of 3 to 8 carbon atoms, inclusive, such as cyclopropyl, cyclobutyl, cyclopentyl, cyclohexyl, cycloheptyl, cyclooctyl and the like.

The term "hydroxyalkyl" means alkyl as defined above having for example 2 to 6 carbon atoms, inclusive, and wherein a hydrogen atom has been replaced by a hydroxyl group. Illustrative of hydroxyalkyl groups of 2 to 6 carbon atoms, inclusive, are hydroxyethyl, hydroxypropyl, hydroxybutyl, hydroxypentyl, hydroxyhexyl, and isomeric forms thereof.

Representative of preferred amine bases are those of low volatility such as cyclohexylamine, ethanolamine, methylethylamine, diethylamine, monoethanolamine, diethanolamine, triethanolamine, morpholine, alkyl-substituted morpholine and piperidine and mixtures of these with each other and the like.

Carboxylic acids having a molecular weight of from 46 to about 210, used to form the above-described buffer salts are also well-known compounds. Representative of such carboxylic acids are formic acid, acetic acid, n-propionic acid, isopropionic acid, n-butyric acid, pivalic acid, t-butylacetic acid, oxalic acid, malonic acid, succinic acid, glutaric acid, adipic acid, citric acid, tartaric acid, maleic acid, 1, 10-decanedicarboxylic acid and the like. Preferred carboxylic acids are those having 1 to 4 carbon atoms, inclusive (except the butyric acids lend odor to the developing process).

The buffer salts of the amine base and the carboxylic acids may be performed and admixed with the other components of the developer solutions of the invention or they may be formed in-situ by admixture of the component base and acid directly with the remaining ingredients of the developer solutions of the invention. The proportion of the buffer salt employed to prepare the developer solutions of the invention may vary over a broad range. Advantageously, 2.0 to 7.5 millimols are present for application per square meter of diazotype material for development, i.e.; about 0.89 to 3 millimols per gram of developer solution.

Liquid, non-volatile, organic diluents for the couplers and buffer salts described above are well-known organic compounds as is their preparation. Representative of such diluent compounds are high boiling polyalcohols and their partial ethers such as hexylene glycol, diethylene glycol, polyethylene glycol, trimethylene glycol, ethylene glycol, propylene glycol, dipropylene glycol, glycerine, 4-methoxy-4-methyl-pentanol-2(pentoxol), 2-ethylhexanol, cyclohexanol, isooctyl alcohol, hexanol and the like. Also glycol ethers such as ethylene glycol monoethyl ether (Cellosolve), diethylene glycol monoethylether, ethylene glycol mono butyl ether (butylcellosolve), and the like. Solvents for the other components of the developer solutions are preferred diluents. Also preferred as the organic diluent component of the developer solutions of the invention are diethylene glycol, dipropylene glycol, glycerine and low molecular weight (liquid) polyalkylene glycols such as liquid polyethylene glycol, polypropylene glycol having a molecular weight of 200 to 800 and the like. Sufficient diluent is employed to substantially dilute the buffer salts and dissolve the azodye coupler. Preferably 1 to 3 mg. of diluent is provided for each mg. of amine salt and azodye coupler together (25 to 50% by weight of developer solution).

The developer solutions of the present invention are adjusted to pH values within the range of 5.5 to 7 for use with the so called one component diazotypes (see Kosar, supra. page 255), for "acid" development. The developer solutions are stable over a long period and thus do not require frequent cleaning of the developer apparatus. Surprisingly, however, the present invention is not only applicable to one component diazotype papers that are sensitized with diazo compounds that are conventionally used for "acid" development, but also performs with diazo compounds that are conventionally used for "alkaline" development. The class of diazo compounds for conventional acidic development may be represented by 1-diazo-2,5-dibutoxy-4-benzolyamino benzene, chloride ½ zinc chloride (Diazo 22*),
1-diazo-2,5-dimethoxy-4-p-tolylmercapto-benzene chloride ½ zinc chloride (Diazo 32*),
4-diazo-2,5,4'-trihydroxy diphenyl oxalate (Diazo 42*),
1-diazo-2,5-diethoxy-4-p-tolymercapto-benzene chloride ½ zinc chloride (Diazo 72*),
1-diazo-3-ethoxy-4-[N-benzyl-N-methylamino]-benzene chloride zinc chloride (Diazo 74*),
1-diazo-3-chloro-4-N,N-dibutylamino-benzene borofluoride (Diazo 75*),
1-diazo-2-chloro-5-(4'-chlorophenoxy)-4-N,N-diethyl aminobenzene chloride ½ zinc chloride (Diazo 78*),
1-diazo-2-chloro-5-(4'-chlorophenoxy)-4-N,N-dimethyl aminobenzene chloride ½ zinc chloride (Diazo 79*),
1-diazo-3-chloro-4-N-methyl-N-cyclohexylamino-benzene chloride ½ zinc chloride (Diazo 87*), and the like. Representative of the class of diazo compounds used conventionally in alkaline development processes are 1-diazo-4-(N-ethyl-N-benzyl) amino-benzene chloride ½ zinc chloride (Diazo 14*),
1-diazo-2,5-dibutoxy-4-morpholino-benzene chloride ½ zinc chloride (Diazo 54*),
1-diazo-3-chloro-4-N,N-diethylamino-benzene chloride ½ zinc chloride (Diazo 77*), and the like.

*Andrews Paper & Chemical Co. Inc., Port Washington, N.Y. 11050.

Generally, diazos of the latter class used in alkaline developing solution processes need more time after application of the developer to reach full print dye strength when left at room temperature. A short heating after development brings out the full dye strength immediately. This feature of the present invention is of great interest because the class of alkaline diazos, heretofore, could not be developed with neutral developers, but only with alkaline developers (which result in poorer print background stability against discoloration).

Another merit of this feature of the present invention is the applicability of Diazo 54* supra., for superfast printing diazotypes which is much more economical than Diazo 78* supra., that had to be used heretofore for acidic developed diazotypes. Diazo 54* supra., does not develop satisfactorily with conventional acid and neutral development processes and thus had been previously restricted for use with alkaline developers.

The developer solutions of the invention may contain any number of additional ingredients conventionally used in the preparation of prior art light-sensitive coating developer compositions such as, for example, solubilizers, fillers, stabilizers, accelerators, surfactants, antioxidants, contrast controlling compounds, lubricants and the like. Although the developer solutions of the invention are preferably substantially anhydrous, i.e., do not have a water content exceeding the water normally associated with the component ingredients (less than about 5 percent water), one may add water as a diluent. The added water may be as much as up to 60 percent by weight of the developer solution.

The method of the invention is carried out by spreading on the surface of a light-sensitized, image-wise exposed diazotype material, a developing solution of the invention at a rate of from about 0.8 gms to 4 gms. per square meter, preferably 1 to 1.5 gms per square meter. Development starts instantly without generation of any curl in the finished print and the print is finished without the need for any additional steps such as drying. Spreading of the developer solution may be carried out using any conventional diazotype developing apparatus adapted for the moist development process, and transferring 0.8 g to 4 g/m$^2$ developer to one side of the print only. The developer solutions of the invention may also include a proportion of water to accommodate use in developer apparatus which requires or inherently applies more liquid than 1.5 gms cm$^2$ to the diazotype material surface.

The following examples describe the manner and process of making and using the invention and set forth the best mode contemplated by the invention of carrying out the invention but are not to be construed as limiting.

EXAMPLE 1

Diazo base paper of 75 g/m$^2$ basis weight is provided with a precoat of the following composition:

| | |
|---|---|
| ammonia (25%) | 3 cc |
| pigment 2820* | 50 g |
| polyvinylacetate (50% dispersion) | 75 cc |
| in water enough to yield | 1000 cc |

*Non Colloidal Silica; Andrews Paper & Chemical Co., supra.

15 cc of the precoat per square meter is applied in a conventional diazotype coating machine with an air-knife coating head, and dried to 4–5% residual moisture. The precoated paper is then overcoated with a diazo sensitizing solution of the following composition:

| | |
|---|---|
| citric acid | 10 g |
| urea | 30 g |
| Diazo #72 (Andrews, supra.) | 10 g |
| naphthalene trisulfonic acid | 10 g |
| isopropyl alcohol | 10 cc |
| aluminum sulfate | 10 g |
| water to complete to | 1000 cc |

15 cc per square meter of the sensitizing solution is applied to the precoated surface in a conventional diazotype coating machine and dried and the paper is then backcoated with water for curl control and dried again to a residual moisture of 3.5%.

The sensitized paper is cut into sheets of convenient size and imagewise exposed in a diazotype copying machine and then passed through the developing section of a Model PD-80 machine, a pressure development machine manufactured and sold by the Bruning Division of the AM Co., filled with the following developer solution:

| | |
|---|---|
| dipropylene glycol | 200 cc |
| polyethylene glycol (M.W. 400) | 300 cc |
| polypropylene glycol methyl ether | 100 cc |

-continued

| | |
|---|---|
| diethanolamine | 270 cc |
| formic acid (85%) | 120 cc |
| phloroglucinol | 35 g |
| resorcinol | 30 g |

The pH value of the developer solution is 6.

After the sheet passes through the developer section of the machine it will have picked up 1.4 g per square meter of the above described developer on the front side. The print dye forms immediately and after 15 seconds the full dye strength is reached. A blackline print on a clear white background is obtained, dry to the touch and without any curl.

EXAMPLE 2

Example 1 is repeated except in the diazo the Diazo 72 is replaced with an equal amount of Diazo #78*. After passage through the developer section the print will have picked up 1.3 g/m$^2$ developer solution and the print dye forms equally fast. A blackline print on a clear white background is obtained, without any curl.

*Andrews Paper and Chemical Co., Supra.

EXAMPLE 3

Example 1 is repeated except in the diazo sensitizing solution the Diazo 72 is replaced by an equal amount of Diazo 54*. After passage through the developer section the print will have picked up 1.4 g/m$^2$ of developer solution. The print dye starts to generate slowly. The print is exposed to moderate radiating heat from an electrical resistance and the full print dye density is then achieved within 5 seconds. The print has no curl.

*Andrews Paper and Chemical Co., supra.

EXAMPLE 4

Example 1 is repeated except the developer solution is replaced by the following developer solution:

| | |
|---|---|
| polyethylene glycol (M.W. 400) | 200 cc |
| diethylene glycol | 300 cc |
| aminoethylpiperazine | 160 cc |
| formic acid (85%) | 120 cc |
| phloroglucinol | 30 g |
| resorcinol | 25 g |

The pH value of the developer solution is 5.6. After passage through the developer section the print will have picked up 1.1 g/m$^2$ of developer.

The obtained print quality equalled that obtained in Example #1. The developer solution is left in the developing machine and observed over a period of 2 days with frequent prints made during that period. No obvious change occurred nor any loss in the performance of the developer.

EXAMPLE 5

Example 1 is repeated except that the developer solution is replaced by the following developer solution:

| | |
|---|---|
| polyethylene glycol (M.W. 400) | 200 cc |
| diethylene glycol | 300 cc |
| morpholine | 225 cc |
| formic acid 85% | 120 cc |
| phloroglucinol | 30 g |
| resorcinol | 25 g |

The pH value of the solution is 6.

After passage through the developer section the print will have picked up 1.3 g/m² of developer solution and the print dye forms equally fast. A blackline print on white background is obtained, free of curl.

EXAMPLE 6

This is not an example of the invention, but is made for comparison. The procedure of Example 5 is repeated except that in the developer solution, the 200 cc polyethylene glycol and 300 cc diethylene glycol ingredients are replaced with 500 cc of water. The pH of the developer is 6.

After passage through the developer section the print will have picked up 1.2 g/m² of developer solution.

Development starts very slowly and after one hour the print dye density reaches only 50% of the print dye density of the print from Example #5.

When a print is passed 3 times through the developer section and has picked up approximately 3.5 g/m² developer solution, a similar degree of development as in Example #5 is obtained, but the print exhibits curl.

EXAMPLE 7

This is not an example of the invention, but is made for comparison. Example 1 is repeated except that the developer solution as used therein is replaced by the following developer solution:

| | |
|---|---|
| water | 800 cc |
| succinic acid | 89 g |
| sodium hydroxide | 72 g |
| phloroglucinol | 30 g |

The pH value of the solution is 6.

After passage through the developer section the print will have picked up 1.1 g/m² of developer solution.

The print dye forms very slowly and after one hour the print line density reaches only about 40% of the line density obtained in Example #1. When a print is developed 4 times it finally reaches the print line density obtained in Example #1, but exhibits curl.

When the developer of Example #7 is left in the developing machine for 24 hours, it starts to crystallize.

EXAMPLE 8

Example 1 is repeated except the developer solution as used therein is replaced with the following developer solution:

| | |
|---|---|
| polyethylene glycol (M.W. 400) | 200 cc |
| diethylene glycol | 200 cc |
| water | 100 cc |
| morpholine | 225 cc |
| formic acid (85%) | 120 cc |
| phloroglucinol | 30 g |

The pH value of the developer solution is 6.

After passage through the developer section the print will have picked up 1.1 g/m² of developer solution and the print dye forms equally fast. A blackline print on white background is obtained, free of curl.

EXAMPLE 9

Example #1 is repeated except that the developer solution as used therein is replaced by the following developer solution:

| | |
|---|---|
| glycerine | 200 cc |
| polyethylene glycol (M.W. 400) | 200 cc |
| diethylene glycol | 100 cc |
| diethanolamine | 270 cc |
| citric acid | 50 g |
| formic acid (85%) | 60 cc |
| phloroglucinol | 30 g |
| resorcinol | 25 g |

The pH value of the developer solution is 5.7.

After passage through the developer section, the print will have picked up 1.2 g/m² of developer solution and the print dye forms fast. A blackline print on white background is obtained, free of curl.

EXAMPLE 10

100% rag paper of 53 g/m² basis weight is transparentized by saturating it with a solution of polybutene in mineral spirit and then evaporating the mineral spirit. The basis weight after transparentizing is 60 g/m².

The transparentized paper is precoated with the same precoat used in Example #1 and then overcoated with the following sensitizing composition:

| | |
|---|---|
| Citric acid | 10 g |
| naphthalene trisulfonic acid (sodium salt) | 40 g |
| isopropyl alcohol | 10 cc |
| Diazo #72 (Andrews, supra.) | 40 g |
| aluminum sulfate | 10 g |
| pigment 2820 | 30 g |
| rice starch | 30 g |
| polyvinylalcohol | 10 g |
| water to complete to | 1000 cc |

at a rate of 15 cc per square meter applied to the precoated surface on the same equipment described in Example No. 1. The paper is dried, then backcoated and dried again to a residual moisture of 3%.

The paper is then cut into sheets of convenient size and after imagewise exposure in a diazotype copying machine it is passed through the developing section of a PD-80 machine as in Example #1 but with the following developer solution:

| | |
|---|---|
| diethylene glycol | 300 cc |
| polyethylene glycol (M.W. 400) | 200 cc |
| diethanolamine | 270 cc |
| formic acid (85%) | 120 cc |
| phloroglucinol | 50 g |
| resorcinol | 30 g |

The pH value of the developer solution is 6.2.

The sheet picked up 1.5 g per square meter of the developer and a deep blackline print on a clear background is obtained. The print gave very satisfactory results when used as second original to produce opaque diazotype prints.

EXAMPLE 11

Example 9 is repeated except that the developer is diluted with 400 cc of water before use. The pH value of the developer is adjusted to 6.2 with addition of diethanolamine.

The developer solution is applied to the print surface with a transfer roller system similar to that described in U.S. Pat. No. 4,128,423. The developer solution is picked up by the print surface at a rate of 2.5 g/m². The print dye forms rapidly and an odor free, flat copy with a high print contrast is obtained which requires no further drying.

EXAMPLE 12

Example #1 is repeated except that the sensitizing solution as used therein is replaced with the following composition:

| | |
|---|---|
| citric acid | 5 g |
| caffeine | 10 g |
| Coupler 144* | 10 g |
| urea | 20 g |
| Diazo 54S (Andrews, supra.) | 10 g |
| naphthalene trisulfonic acid, sodium salt | 30 g |
| saponin | 0.25 g |
| water to complete to | 1000 cc |

*2-Hydroxy Naphthalene-3-carboxylic acid-3'-N-Morpholinopropylamide, Andrews Paper and Chemical Co., supra.

After passage through the developer section, the print picks up 1.5 g/m$^2$ of developer solution and an odor free non curling copy is obtained. When left at the ambient temperature of approximately 70° F., the black print dye develops within 5 minutes to approximately 90% of its full strength. When the print, after development, is exposed to moderate radiating heat from an electrical resistance, the full density forms within 5 seconds. When the same sensitized diazotype paper is imagewise exposed and developed in ammonia, a clear blueline print is obtained.

What is claimed:

1. A liquid developer for the moist development of a latent image on a light-sensitive and exposed diazotype material, which comprises;

(a) an azodye coupler;

(b) a non-volatile salt of an amine base and a carboxylic acid having a molecular weight of from 46 to about 210; and (c) a liquid, non-volatile organic dilutant for (a) and (b) described above, selected from the group consisting of polyhydric alcohols and polyhydric alcohol-ethers;

said developer having a pH within the range of from about 5.5 to about 7.0.

2. The developer of claim 1 which further comprises a proportion of water.

3. The developer of claim 2 wherein the proportion is less that about 50 percent by weight of the developer.

4. The developer of claim 1 in which phloroglucinol is the azodye coupler.

5. The developer of claim 1 in which phloroglucinol and resorcinol are the azodye coupler component.

6. The developer of claim 1 wherein the salt is one selected from the groups consisting of the salt of diethanolamine and formic acid, the salt of aminoethylpiperazine and formic acid, the salt of morpholine and formic acid and the salt of diethanolamine and citric acid.

7. The developer of claim 1 wherein the amine base is selected from the group consisting of diethanolamine, aminoethylpiperazine and morpholine.

8. The developer of claim 1 wherein the carboxylic acid is selected from the group consisting of formic and citric acids.

9. The developer of claim 1 wherein the diluent comprises a member selected from the group consisting of dipropylene glycol, polyethylene glycol, polypropylene glycol, polypropylene glycol methyl ether, diethylene glycol, glycerine and mixtures thereof.

10. A process of developing the latent image on a light-sensitive and exposed diazotype material, which comprises;

applying the developer of claim 1 to said diazotype material.

11. A process of developing one or two component conventional diazotypes to produce a no-drying requiring, non-curling, odor-free print with a positive azodye image, which comprises applying, after imagewise exposure, to the sensitized side of the print, a composition comprising:

(1) buffer salts of aminoalcohols, amines or polyamines and mono or polyvalent organic carboxylic acids with a MW of 46-210;

(2) an azodye coupler with higher coupling strength than the ones conventionally used in 2-component diazotypes; and (3) a liquid vehicle as a diluent for (1) and (2) and consisting of liquid polyols with or without their lower alkyl mono ethers and without or with up to 60% by weight water;

the composition being adjusted to a pH of between 5.5 and 7 with either the basic or the acidic component (1) and the composition being applied to the print surface to deposit per square meter:

0.2 to 4.0 milliequivalents of the azodye couplers;

2.0 to 7.5 millimols of the buffer salt and;

500 mg to 1500 mg of non-aqueous part of the vehicle; and 0 mg to 2250 mg of water.

12. A process of developing one or two component conventional diazotypes according to claim 11 in which the azodye coupler is phloroglucinol.

13. The process fo claim 12 wherein the coupler is a mixture of phloroglucinol and resorcinol.

* * * * *